United States Patent [19]

Roberts

[11] 3,936,911

[45] Feb. 10, 1976

[54] METALLIC FLAT CLOTHING

[75] Inventor: Marion Winifred Roberts, Greenville, S.C.

[73] Assignee: John D. Hollingsworth on Wheels, Inc., Greenville, S.C.

[22] Filed: Oct. 7, 1974

[21] Appl. No.: 512,451

[52] U.S. Cl. ..... 19/113

[51] Int. Cl.[2] ..... D01G 15/24

[58] Field of Search ..... 19/112, 113, 114, 234

[56] References Cited

UNITED STATES PATENTS 3,737,953 6/1973 Bechtel, Jr. ..... 19/113

FOREIGN PATENTS OR APPLICATIONS 934,118 8/1963 United Kingdom ..... 19/113

1,171,625 11/1969 United Kingdom ..... 19/234

*Primary Examiner*—Dorsey Newton

*Attorney, Agent, or Firm*—Bailey & Dority

[57] ABSTRACT

Flat clothing is illustrated utilizing metallic wire segments affixed to an elongated base strip, within a channel therein extending the length of the strip, by an adhesive which is carried within vertical passageways or reservoirs extending entirely across vertical side surfaces of the shoulders of said segments affixing the segments to each other and to the base strip.

2 Claims, 4 Drawing Figures

METALLIC FLAT CLOTHING

This invention relates to metallic flat clothing wherein means are provided for supporting and fixing wire segments to each other and to a carrier or base strip so that parallel rows of teeth are provided for positioning in substantial alignment and in opposed relation with teeth on the main cylinder of a carding machine.

BACKGROUND OF THE INVENTION

A metallic flat clothing has been provided heretofore with limited success. It has been necessary to provide end clips of U-shaped configuration for fitting over the ends of segments for attaching them to an elongated base member. The number of segments which must be manipulated and thus affixed has been prohibitive from a practical manufacturing standpoint. Generally, therefore, the usual flexible clothing utilizing pins projecting through a base material is employed on flat top cards.

Efforts to provide metallic flat clothing have continued such as illustrated in United States Letters patent Nos. 3,737,953 and 3,793,677. Such devices again are difficult to position since the wires must be bent or otherwise inclined to the direction of fiber flow requiring considerable manipulation in constructing the clothing.

Accordingly, it is an important object of this invention to provide metallic flat clothing wherein a number of wire segments may be readily manipulated and firmly affixed to a base strip for use as clothing on a flat top card.

Another important object of the invention is to provide metallic flat clothing wherein the strips are readily and firmly affixed to each other and to a base member in alignment with the fiber flow and the teeth of the card clothing on the main cylinder.

SUMMARY OF THE INVENTION

It has been found that metallic flat clothing may be constructed utilizing an elongated base strip having a channel therein for receiving segments of metallic wire, wherein a plurality of closely spaced, substantially vertical passageways or reservoirs are formed on one or more sides of the shoulders of said strips extending therethrough for facilitating the flow and subsequent retention of a curable, liquid adhesive therein for bonding the segments to each other and to the base member.

BRIEF DESCRIPTION OF THE DRAWINGS

The construction designed to carry out the invention will be hereinafter described, together with other features thereof.

The invention will be more readily understood from a reading of the following specification and by reference to the accompanying drawing forming a part thereof, wherein an example of the invention is shown and wherein.

DESCRIPTION OF A PREFERRED EMBODIMENT

Figure 1:
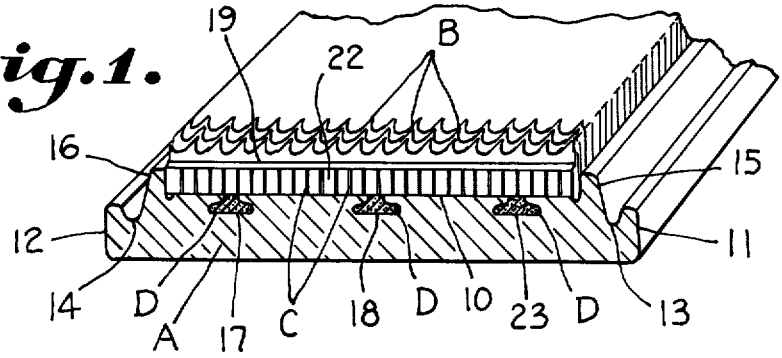
FIG. 1 is a perspective view illustrating metallic flat clothing constructed in accordance with the present invention.
Figure 2:
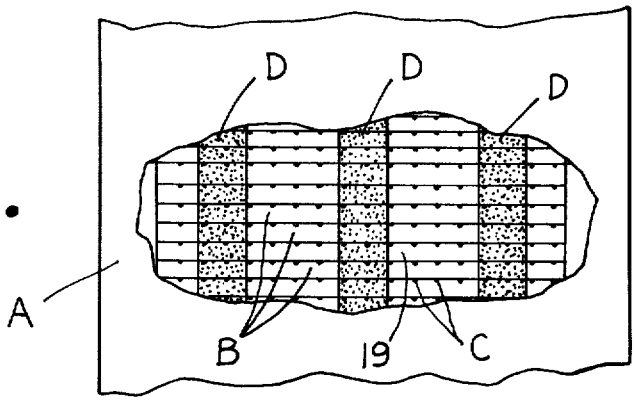
FIG. 2 is a bottom plan view with parts broken away for illustrating a base portion of the metallic segments and adhesive for securing the segments to each other and to the base strip.

The drawing illustrates flat clothing having metallic card clothing for use on a flat top card. An elongated base strip A has a longitudinal channel therein extending the length thereof for receiving metallic card clothing transversely therein. The metallic card clothing includes a plurality of segments of wire B each having a shoulder carrying upstanding teeth adjacent one side thereof. A plurality of spaced substantially vertical passageways C extend entirely across a vertical side surface of said shoulder of each of said segments. The segments B are stacked in aligned relation transversely of said channel with each shoulder abutting a next succeeding shoulder forming aligned rows of teeth extending transversely across and projecting above the base strip. An adhesive D substantially fills the vertical passageways affixing each segment to the next succeeding segment and to the base strip.

The elongated base strip A has a longitudinal channel 10 therein extending the length thereof for receiving the metallic card clothing. The base strip A has upstanding edges 11 and 12 defining a longitudinal recess 13 and 14, respectively, adjacent each edge for receiving a clip, described in greater detail below, for affixing the flat clothing for use on a flat top card. The channel 10 is formed between upward projections 15 and 16 and has longitudinal keyway slots 17, 18 and 23 equally spaced in the base of the channel 10 for receiving adhesive D, thereby locking wire segments B to base strip A. Each of the wire segments B has a shoulder 19 (FIG. 3) and a row of teeth 20 is formed in a rolled portion 21 extending upwardly adjacent one side of the shoulder 19.

The plurality of spaced, substantially vertical passageways C are formed in a side 22 of said shoulder remote from the teeth 20. The vertical passageways are illustrated as being in the form of substantially rectangular channels formed by the feed rolls as the metallic wire is being manufactured. The feed rolls may apply vertical passageways on the side 22 of the shoulder 19 remote from the teeth or the passageways may be provided on the other side of the shoulder or on both sides. If the passageways are provided on the tooth side of the shoulder, they should extend across the rolled portion 21 as well as the side portion opposite the side 22 of the shoulder 19.

Figure 3:
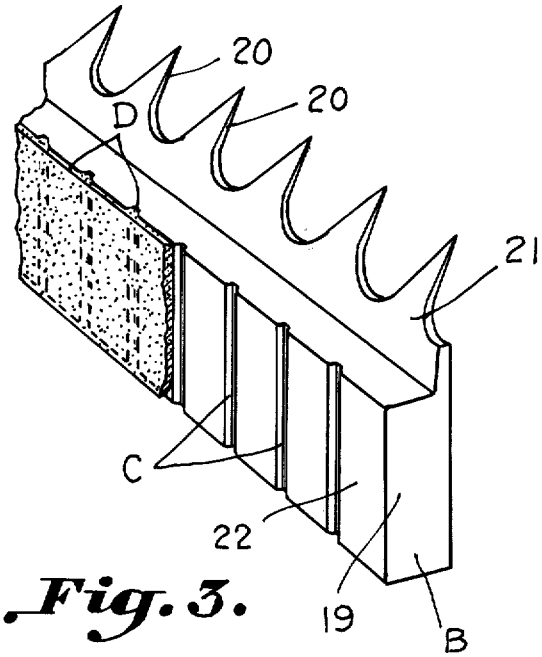
FIG. 3 is an enlarged, perspective view illustrating segments of metallic wire card clothing having spaced vertical passageways extending entirely across a vertical side surface of a shoulder thereof.

The segments B are assembled in stacked relation and aligned transversely of the channel with each shoulder abutting a next succeeding shoulder. A suitable liquid adhesive is then poured across the teeth and such flows downwardly into the channel 10 and keyway slots 17, 18 and 23. The adhesive D, in addition to filling the keyway slots 17, 18 and 23 fills the passageways C and fills the spaces between the passageways C and the next adjacent segment as illustrated in FIG. 3. Any suitable, curable liquid adhesive may be used. An adhesive which has been used successfully is Product EC-1294 manufactured by the 3M Company.

Figure 4:
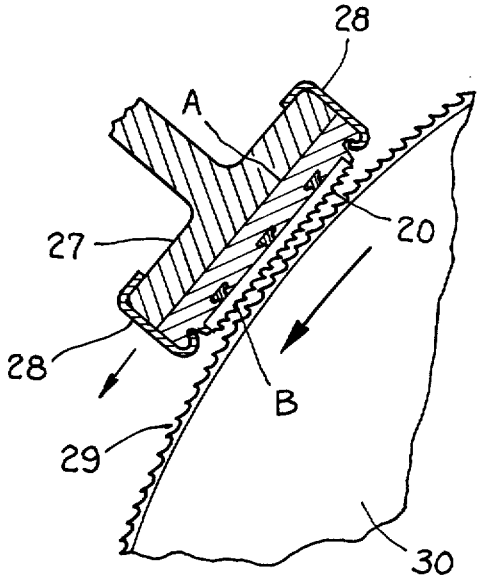
FIG. 4 is a longitudinal, sectional elevation illustrating metallic flat clothing constructed in accordance with the present invention positioned for use on a flat top card.

FIG. 4 illustrates the manner of attaching the base strip A and metallic segments carried thereby to a base 27. Elongated U-shaped clips 28 affix the edges 11 and 12 of the strips to the base 27. It will be noted that the teeth 29 of the card clothing of the cylinder 30 face in an opposite direction to the teeth 20 of the clothing of the metallic flat strips. The main cylinder turns in the direction of the arrow rotating at a high speed while the flats also move in the direction of the arrow but at conventionally a much slower speed.

While a preferred embodiment of the invention has been described using specific terms, such description is for illustrative purposes only and it is to be understood that changes and variations may be made without departing from the spirit or scope of the following claims.

What is claimed is:

1. A flat strip having metallic card clothing for use on a flat top card comprising:

an elongated base strip having a longitudinal channel therein extending the length thereof for receiving metallic card clothing transversely therein;

said metallic card clothing including a plurality of segments of wire each having a base carrying upstanding teeth adjacent one edge thereof;

a plurality of spaced substantially vertical passageways extending entirely across a vertical side surface of said base of each of said segments;

said segments being stacked in aligned relation transversely of said channel with each base abutting a next succeeding base forming aligned rows of teeth extending transversely across and projecting above said base strip;

an adhesive substantially filling said vertical passageways affixing each strip to the next succeeding strip and to the base strip; and at least one open longitudinal slot in a base of said channel forming a reservoir for receiving adhesive having been poured over said segments and flowing through said vertical passageways attaching said segments to said base strip.

2. The structure set forth in claim 1, wherein said at least one slot is a keyway slot.

* * * * *